US008364048B2

(12) United States Patent
Iwaya et al.

(10) Patent No.: US 8,364,048 B2
(45) Date of Patent: Jan. 29, 2013

(54) FIXING DEVICE AND IMAGE FORMING APPARATUS INCLUDING SAME

(75) Inventors: Naoki Iwaya, Chofu (JP); Masanao Ehara, Zama (JP); Yoshiki Yamaguchi, Sagamihara (JP); Yutaka Ikebuchi, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 334 days.

(21) Appl. No.: 12/805,818

(22) Filed: Aug. 20, 2010

(65) Prior Publication Data

US 2011/0044706 A1 Feb. 24, 2011

(30) Foreign Application Priority Data

Aug. 24, 2009 (JP) ..... 2009-193136
May 26, 2010 (JP) ..... 2010-120103

(51) Int. Cl.
*G03G 15/20* (2006.01)
*G03G 15/00* (2006.01)

(52) U.S. Cl. ..... 399/33; 399/90

(58) Field of Classification Search ..... 399/33, 399/69, 90

See application file for complete search history.

(56) References Cited

U.S. PATENT DOCUMENTS 5,737,664 A * 4/1998 Fukuda et al. ..... 399/33
5,832,354 A 11/1998 Kouno et al.
5,915,147 A 6/1999 Kouno et al.
6,219,520 B1 4/2001 Ehara
6,628,916 B2 9/2003 Yasui et al.
6,636,709 B2 10/2003 Furukawa et al.
6,778,790 B2 8/2004 Yoshinaga et al.
6,785,505 B2 8/2004 Yasui et al.
6,807,386 B2 10/2004 Yasui et al.
6,881,927 B2 4/2005 Yoshinaga et al.
6,882,820 B2 4/2005 Shinshi et al.
6,892,044 B2 5/2005 Yasui et al.
7,022,944 B2 4/2006 Yoshinaga et al.
7,127,204 B2 10/2006 Satoh et al.
7,239,838 B2 7/2007 Sato et al.
7,242,897 B2 7/2007 Satoh et al.
7,313,353 B2 12/2007 Satoh et al.
7,437,111 B2 10/2008 Yamada et al.
7,454,151 B2 11/2008 Satoh et al.
7,466,949 B2 12/2008 Satoh et al.
7,509,085 B2 3/2009 Yoshinaga et al.

(Continued)

FOREIGN PATENT DOCUMENTS

JP 2001-156471 6/2001
JP 2003-015463 1/2003

*Primary Examiner* — Walter Lindsay, Jr.
*Assistant Examiner* — Rodney Bonnette
(74) *Attorney, Agent, or Firm* — Harness, Dickey & Pierce, P.L.C.

(57) ABSTRACT

A fixing device including a fixing member; a heat source to heat the fixing member; a power supply to supply power to the heat source; a thermostat provided in the middle of a circuit connecting the heat source and the power supply to block power supply from the power supply to the heat source upon detection of a temperature of the fixing member equal to or greater than a predetermined temperature; a support member to contact terminals fixed to the thermostat to support the thermostat; and electrode plates provided opposite the support member with a gap therebetween to form a part of the circuit by connecting to surfaces of the terminals of the thermostat opposite surfaces thereof contacting the support member while the terminals are positioned within the gap. The electrode plates include a first guide part to guide the terminals into the gap.

15 Claims, 8 Drawing Sheets

U.S. PATENT DOCUMENTS

| | | | | |
|---|---|---|---|---|
| 7,546,049 | B2 | 6/2009 | Ehara et al. | |
| 7,702,271 | B2 | 4/2010 | Yamada et al. | |
| 2002/0018663 | A1 | 2/2002 | Furukawa et al. | |
| 2002/0057919 | A1* | 5/2002 | Tomatsu | 399/69 |
| 2002/0067936 | A1 | 6/2002 | Yasui et al. | |
| 2003/0000933 | A1 | 1/2003 | Yoshinaga et al. | |
| 2003/0007813 | A1 | 1/2003 | Yasui et al. | |
| 2003/0016963 | A1 | 1/2003 | Yoshinaga et al. | |
| 2003/0206758 | A1 | 11/2003 | Yasui et al. | |
| 2004/0013453 | A1 | 1/2004 | Shinshi et al. | |
| 2004/0042825 | A1 | 3/2004 | Yasui et al. | |
| 2005/0095043 | A1 | 5/2005 | Yoshinaga et al. | |
| 2005/0163543 | A1 | 7/2005 | Satoh et al. | |
| 2005/0180786 | A1 | 8/2005 | Yamada et al. | |
| 2006/0116230 | A1 | 6/2006 | Satoh et al. | |
| 2006/0165429 | A1 | 7/2006 | Satoh et al. | |
| 2006/0165443 | A1 | 7/2006 | Yoshinaga et al. | |
| 2006/0257183 | A1 | 11/2006 | Ehara et al. | |
| 2007/0014603 | A1 | 1/2007 | Satoh et al. | |
| 2007/0154252 | A1* | 7/2007 | Yoshida | 400/670.3 |
| 2008/0063443 | A1 | 3/2008 | Yoshinaga et al. | |
| 2008/0317532 | A1 | 12/2008 | Ehara et al. | |
| 2009/0010687 | A1 | 1/2009 | Yamada et al. | |
| 2009/0123201 | A1 | 5/2009 | Ehara et al. | |
| 2009/0148204 | A1 | 6/2009 | Yoshinaga et al. | |
| 2010/0074667 | A1 | 3/2010 | Ehara et al. | |

* cited by examiner

FIXING DEVICE AND IMAGE FORMING APPARATUS INCLUDING SAME

PRIORITY STATEMENT

The present patent application claims priority from Japanese Patent Application Nos. 2009-193136, filed on Aug. 24, 2009, and 2010-120103, filed on May 26, 2010, both in the Japan Patent Office, each of which is hereby incorporated herein by reference in its entirety.

BACKGROUND

1. Technical Field

Illustrative embodiments described in this patent specification generally relate to a fixing device and an image forming apparatus, and more particularly to a fixing device including a thermostat that can be easily installed in the fixing device, and an image forming apparatus including the fixing device.

2. Description of the Related Art

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

Although a thermostat has been widely used to prevent an excess temperature increase of the fixing device, the method for installing the thermostat in the fixing device and the position at which the thermostat is installed in the fixing device require a design that takes into consideration various restrictions, including mechanical tolerances of each component and overall safety requirements. For example, in a configuration in which an electrode plate is used for the primary circuit, the electrode plate must be spaced a certain distance apart from other metal sheet components to comply with safety standards because the electrode plate is uncoated and unprotected. Further, the electrode plate must be initially installed inside an external cover of the fixing device in order to prevent electrical shock during installation. Consequently, the various restrictions described above make it difficult to install the thermostat between the electrode plate and a housing that accommodates the thermostat after installation of the electrode plate and the housing in the fixing device.

In order to facilitate installation of a conductive plate in the housing, one example of a related-art image forming apparatus includes a configuration in which a blocking device, that is, a thermostat, is rotated at a certain angle while the conductive plate is fitted into a fitting groove in the housing to engage a terminal of the conductive plate with an engaging groove in the housing.

However, in the above-described image forming apparatus, how to facilitate installation of the thermostat is not suggested or taught. Further, because of the restrictions described previously, installation of the thermostat is not sufficiently facilitated even if the above-described configuration is applied to installation of the thermostat in the fixing device.

SUMMARY

In view of the foregoing, illustrative embodiments described herein provide a fixing device in which a thermostat can be easily installed with higher positional accuracy while receiving benefits from advantages of using an electrode plate for a primary circuit, and an image forming apparatus including the fixing device.

At least one embodiment provides a fixing device including a fixing member; a heat source to heat the fixing member; a power supply to supply power to the heat source; a thermostat provided in the middle of a circuit connecting the heat source and the power supply to block power supply from the power supply to the heat source upon detection of a temperature of the fixing member equal to or greater than a predetermined temperature; a support member to contact terminals fixed to the thermostat to support the thermostat; and electrode plates provided opposite the support member with a gap therebetween to form a part of the circuit by connecting to surfaces of the terminals of the thermostat opposite surfaces thereof contacting the support member while the terminals are positioned within the gap. The electrode plates include a first guide part to guide the terminals into the gap.

At least one embodiment provides an image forming apparatus including the fixing device described above.

Additional features and advantages of the illustrative embodiments will be more fully apparent from the following detailed description, the accompanying drawings, and the associated claims.

BRIEF DESCRIPTION OF THE DRAWINGS

A more complete appreciation of the illustrative embodiments described herein and the many attendant advantages thereof will be readily obtained as the same becomes better understood by reference to the following detailed description when considered in connection with the accompanying drawings, wherein.

Figure 1:
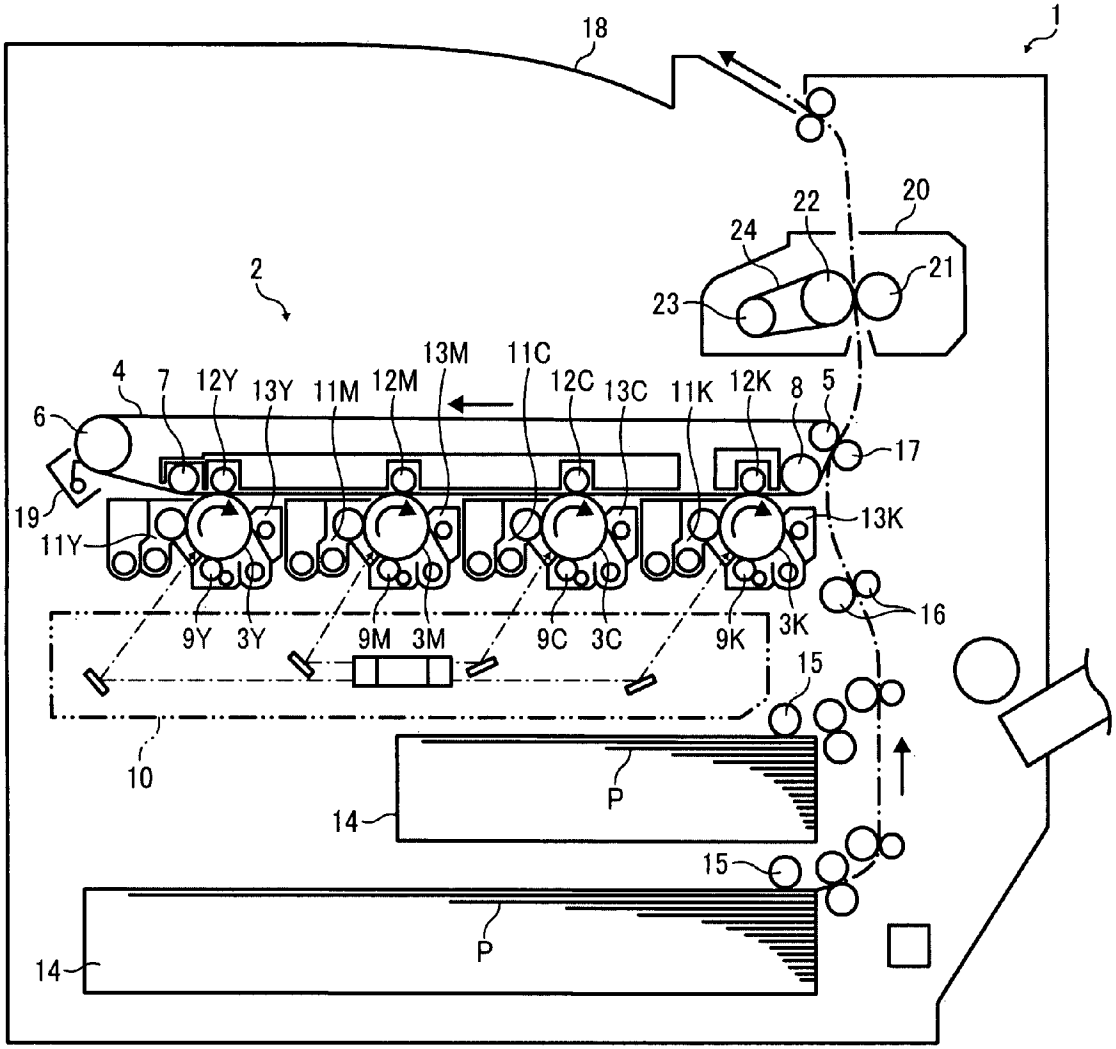
FIG. 1 is a schematic view illustrating a configuration of an image forming apparatus according to illustrative embodiments.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

A description is now given of illustrative embodiments of the present invention with reference to drawings, wherein like reference numerals designate identical or corresponding parts throughout the several views.

FIG. 1 is a schematic view illustrating a configuration of an image forming apparatus 1 according to illustrative embodiments. The image forming apparatus 1 includes an image forming unit 2 and a fixing device 20. The image forming unit 2 includes drum type photoconductors 3Y, 3M, 3C, and 3K (hereinafter collectively referred to as photoconductors 3) each serving as an image carrier onto which a toner image of a specific color, that is, yellow, magenta, cyan, or black, respectively, is formed. An intermediate transfer belt 4 wound around support rollers 5, 6, 7, and 8 to be rotated in a counterclockwise direction in FIG. 1 is provided opposite the photoconductors 3.

The image forming apparatus 1 employs multiple print modes including a full-color mode and a monochrome mode. In the full-color mode, the photoconductors 3 are rotated in a clockwise direction in FIG. 1, and surfaces of the photoconductors 3 are charged to a predetermined polarity by charging rollers 9Y, 9M, 9C, and 9K (hereinafter collectively referred to as charging rollers 9), respectively. Subsequently, a writing unit 10 directs optically modulated laser beams onto the charged surfaces of the photoconductors 3 to form electrostatic latent images of the respective colors on the surfaces of the photoconductors 3. The electrostatic latent images thus formed are then developed with toner of the respective colors by developing devices 11Y, 11M, 11C, and 11K (hereinafter collectively referred to as developing devices 11) to form toner images of the respective colors on the surfaces of the photoconductors 3.

Primary transfer rollers 12Y, 12M, 12C, and 12K (hereinafter collectively referred to as primary transfer rollers 12) are provided opposite the photoconductors 3 with the intermediate transfer belt 4 interposed therebetween. A transfer voltage is applied to each of the primary transfer rollers 12 so that the toner images are primarily transferred from the photoconductors 3 onto the intermediate transfer belt 4. Specifically, the toner images are sequentially transferred onto the intermediate transfer belt 4 and superimposed one atop the other in order from yellow to magenta, cyan, and black, to form a full-color toner image on the intermediate transfer belt 4. After primary transfer of the toner images from the photoconductors 3 onto the intermediate transfer belt 4, cleaning devices 13Y, 13M, 13C, and 13K (hereinafter collectively referred to as cleaning devices 13) removes residual toner from the surfaces of the photoconductors 3, respectively.

As illustrated in FIG. 1, a sheet feeder including sheet feed cassettes 14, each storing recording media such as sheets P and sheet feed rollers 15, is provided at the bottom of the image forming apparatus 1. A sheet P placed at the top of a stack of sheets P in the sheet feed cassette 14 is fed to a pair of registration rollers 16 by rotation of the sheet feed roller 15. The sheet P thus fed is then conveyed at a predetermined timing by the pair of registration rollers 16 to a secondary transfer position formed between the intermediate transfer belt 4 wound around the support roller 5 and a secondary transfer roller 17 provided opposite the support roller 5 with the intermediate transfer belt 4 interposed therebetween. At this time, a predetermined secondary transfer voltage is applied to the secondary transfer roller 17 so that the full-color toner image formed on the intermediate transfer belt 4 is secondarily transferred onto the sheet P.

The sheet P having the full-color toner image thereon is further conveyed to the fixing device 20. In the fixing device 20, heat and pressure are applied to the sheet P to fix the full-color toner image to the sheet P. Thereafter, the sheet P having the fixed full-color image thereon is discharged to a discharge tray 18 provided at the top of the image forming apparatus 1. Meanwhile, a belt cleaning device 19 removes residual toner from the intermediate transfer belt 4 after secondary transfer of the full-color toner image onto the sheet P.

A description is now given of a configuration of the fixing device 20 according to a first illustrative embodiment. Although the fixing device 20 employs a fixing belt system, in which a heat source is provided outside a fixing roller and a fixing belt is wound around the fixing roller, the configuration of the fixing device 20 is not limited thereto. For example, alternatively, the fixing device 20 may employ a fixing roller system having the heat source within the fixing roller.

Figure 2:
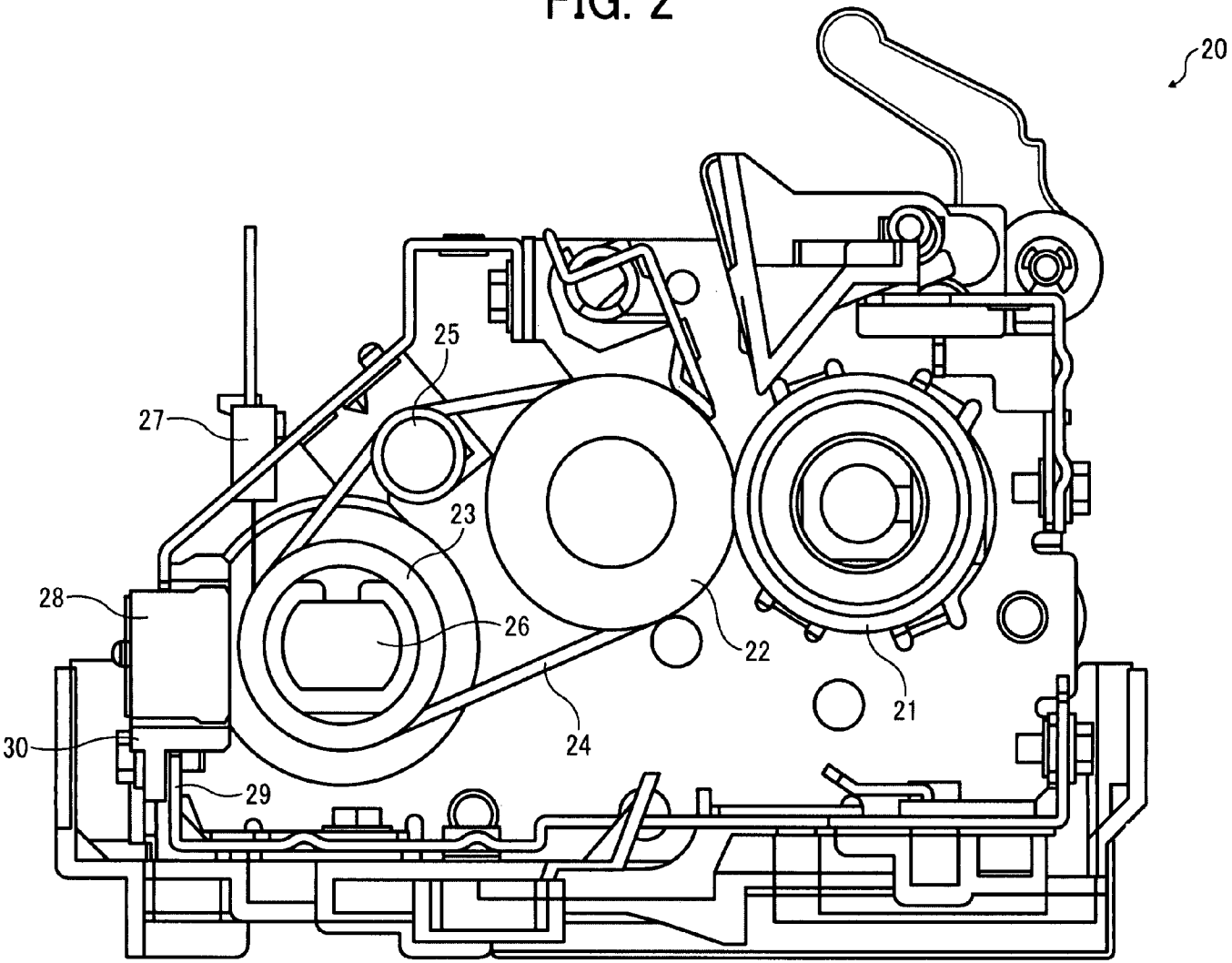
FIG. 2 is a vertical cross-sectional view illustrating an example of a configuration of a fixing device according to a first illustrative embodiment.

FIG. 2 is a vertical cross-sectional view illustrating an example of a configuration of the fixing device 20 according to the first illustrative embodiment. As illustrated in FIG. 2, the fixing device 20 includes a fixing belt 24 serving as a fixing member wound around a fixing roller 22, a heating, roller 23, and a tension roller 25. Specifically, the tension roller 25 provides tension to the fixing belt 24 so that the fixing belt 24 closely contacts the fixing roller 22 and the heating roller 23. A pressing roller 21 is pressed against the fixing belt 24 at a portion wound around the fixing roller 22 to form a fixing nip thereat through which the recording medium passes.

The fixing belt 24 is, for example, a seamless film formed of a heat-resistant resin such as a PI belt, with the resin having a thickness of between 50 μm and 90 μm. An elastic layer formed of silicone rubber, fluorine rubber, or the like, having a thickness of between 100 μm and 300 μm is provided on a substrate of the fixing belt 24 to provide flexibility to the toner image formed thereon. Further, a releasing layer formed of PTF (tetrafluoroethylene-perfluoroalkyl vinyl ether copolymer), PTFE (polytetora fluoro ethylene), or the like, having a thickness of between 20 μm and 50 μm is provided as a top layer of the fixing belt 24. The releasing layer may be covered with a tube, PFA or PTFE in a liquid or powder form, or a film formed by baking.

A heat source 26 is provided within the heating roller 23. A temperature detection element 27 such as a thermistor controls the heat source 26 to turn on and off a heater of the heat source 26 via a control mechanism, not shown, to control a temperature on surfaces of the heating roller 23 and the fixing belt 24. A halogen heater, an infrared heater, or the like, may be used as the heat source 26. The heating roller 23 is formed of a metal such as aluminum or iron. Although the thinner the metal the better, aluminum having a thickness of 0.4 mm or greater or iron having a thickness of 0.2 mm or greater is required because the heating roller 23 is subjected to bending stress from the tension of the fixing belt 24. A black coating material that accelerates heat absorption may be applied inside the heating roller 23 to facilitate heat absorption from the heat source 26.

The fixing roller 22 includes a core, having high rigidity formed of a metal such as iron or aluminum, and a surface of the fixing roller 22, coated with an elastic layer such as silicone rubber. Alternatively, the core of the fixing roller 22 may be formed of a high-rigidity resin. Sponge rubber is best suited as the elastic layer of the fixing roller 22 because of its lower rigidity of 50 Hs or less (measured by ASKER-C type hardness tester manufactured by Kobunshi Keiki Co., Ltd.), thereby reducing load on the fixing belt 24. In addition, the sponge rubber has lower thermal conductivity compared to normal rubber, thereby preventing heat loss from the fixing belt 24.

The tension roller 25 is provided substantially at an intermediate position between the fixing roller 22 and the heating roller 23 around which the fixing belt 24 is wound. The tension roller 25 is pressed against an inner circumferential surface of the fixing belt 24 by a pressing member such as a spring, not shown. The tension roller 25 includes a core having high rigidity formed of a metal or the like, and a surface of the tension roller 25 is coated with a material having a certain level of elasticity such as a heat-resistant felt or silicone rubber. Such a material does not damage the fixing belt 24 when pressed against the fixing belt 24, and can provide a uniform pressing force even under less-accurate setting. Further, thermal conductivity of such a material is not that high, thereby preventing heat loss from the fixing belt 24. It is to be noted that, alternatively, the tension roller 25 may be pressed against an outer circumferential surface of the fixing belt 24, or the heating roller 23 or the fixing roller 22 may be movably provided to also function as and in place of the tension roller 25.

The pressing roller 21 includes a core having high rigidity formed of a metal or the like, and an elastic body such as silicone rubber is provided around the core. It is preferable that a surface of the pressing roller 21 be coated with a material having good releasing properties such as a PFA tube. A thickness of the elastic body of the pressing roller 21 is reduced or a rigidity of the elastic body is increased to make the pressing roller 21 harder and more rigid than the fixing roller 22, thereby concaving the fixing nip toward the fixing roller 22 as illustrated in FIG. 2. Also as illustrated in FIG. 2, the heating roller 23 and the heat source 26 are provided to the fixing roller 22 side, that is, away from the pressing roller 21, so that the temperature of the fixing roller 22 side can be more easily controlled. Therefore, that side of the sheet P which has the toner image thereon faces the fixing roller 22 when the sheet P passes through the fixing nip. In other words, the fixing nip is concaved toward a side same as the side of the sheet P having the toner image thereon.

It is to be noted here that, because an amount of toner of the full-color toner image is larger than that of a monochrome toner image, the sheet P having the full-color toner image thereon tends to separate less easily from the fixing belt 24. However, as described above, the fixing nip is concaved toward the fixing roller 22 to facilitate separation of the sheet P from the fixing belt 24 after the toner image is fixed onto the sheet P.

A thermostat 28 is one of several safety systems employed in the fixing device 20 and is directly connected to a primary circuit. Power is supplied to the thermostat 28 during normal operation. By contrast, when the heat source 26 does not work properly due to a software malfunction or the like and a temperature of the heating roller 23 is excessively increased as a result, the thermostat 28 disconnects the circuit to prevent further heat generation. In other words, the thermostat 28 serves as an excess temperature increase prevention unit.

Figure 3:
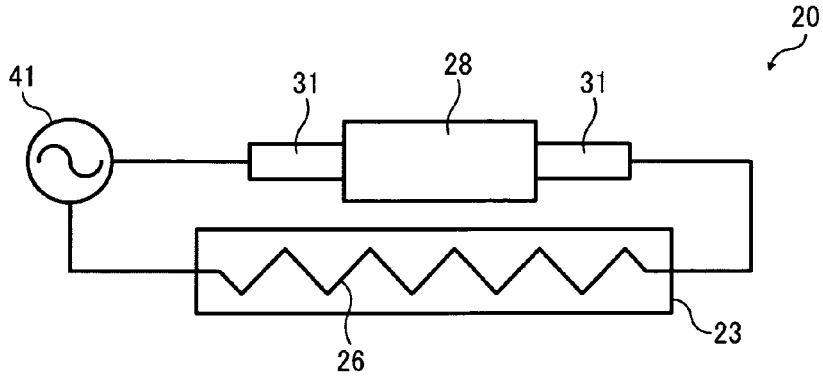
FIG. 3 is a schematic view illustrating a configuration of a primary circuit to which a thermostat included in the fixing device illustrated in FIG. 2 is connected.

FIG. 3 is a schematic view illustrating a configuration of the primary circuit to which the thermostat 28 is connected. As illustrated in FIG. 3, the thermostat 28 is provided in the middle of the primary circuit connecting the heat source 26 that heats the fixing belt 24 through the heating roller 23 and a power supply 41, for example, a commercial power source, that supplies power to the heat source 26. When the temperature of the fixing belt 24 is inappropriately increased over a predetermined temperature, the thermostat 28 disconnects the power supply 41 to the heat source 26 using a bimetal.

A design that takes into consideration various requirements including mechanical tolerances of each component and overall safety is required for both a method for installing the thermostat 28 in the fixing device 20 and the precise position at which the thermostat 28 is installed. In general, a housing 30 formed of a resin serving as a support member is often set to a frame 29 serving as an installation reference to install the thermostat 28 in the housing 30. Because it is directly connected to the primary circuit as described above, the thermostat 28 is required to be securely covered with the housing 30 having insulation to reliably prevent the thermostat 28 from contacting other sheet metal components included in the fixing device 20.

A gap between the thermostat 28 and the fixing belt 24 is very important to make the thermostat 28 function properly. However, because of the large number of related components, a position to install the thermostat 28 must be designed taking into consideration tolerance accumulation. Specifically, the thermostat 28 must be arranged with a certain gap from the fixing belt 24. It is to be noted that, although the thermostat 28 is vertically positioned next to the heating roller 23 in FIG. 2, the installation position of the thermostat 28 is not limited thereto. For example, the thermostat 28 may be provided at any position within a range where the fixing belt 24 and the heating roller 23 closely contact each other.

As described above, accuracy is required for the installation position of the thermostat 28. As a result, various requirements must be met by the method for installing the thermostat 28.

It is to be noted that, although a harness has been widely used in a general primary circuit, the harness must be clamped on the frame 29 or the like to connect the primary circuit to the thermostat 28, requiring a double coating of insulation of the harness for safety purposes. As a result, a diameter of the harness is increased, and a large installation space is required for the harness within the fixing device 20. In addition, because of its unstable shape, the harness cannot be stably clamped at some portions, possibly causing problems and inconvenience during installation. Further, because related components such as the heating roller 23 and the fixing belt 24 are positioned close to one another around the thermostat 28, an external force applied to the harness during installation may cause the harness to contact the fixing belt 24 or the like due to its unstable shape, possibly damaging the fixing belt 24.

To solve the above-described problems, a part of a conducting line of the primary circuit is formed of electrode plates 31 as illustrated in FIG. 3. It is to be noted that the electrode plates 31 form at least parts of the conducting line of the primary circuit next to both terminals of the thermostat 28, and the harness or the like may be used for the rest of the primary circuit such as the part connected to the heat source 26 or the power supply 41.

A thickness of the electrode plates 31 included in the fixing device 20 is, for example, between 0.3 mm and 0.8 mm, thus stabilizing the shape of the electrode plates 31. Accordingly, the design of the primary circuit is not strictly limited. However, the above-described stable shape of the electrode plates 31 and the large number of related components provided around the thermostat 28 impose some restrictions, such as the order in which the components must be installed. In other words, because more accuracy is required for the installation position of the thermostat 28, the thermostat 28 cannot be merely installed after the related components are installed in predetermined order.

Figure 4:
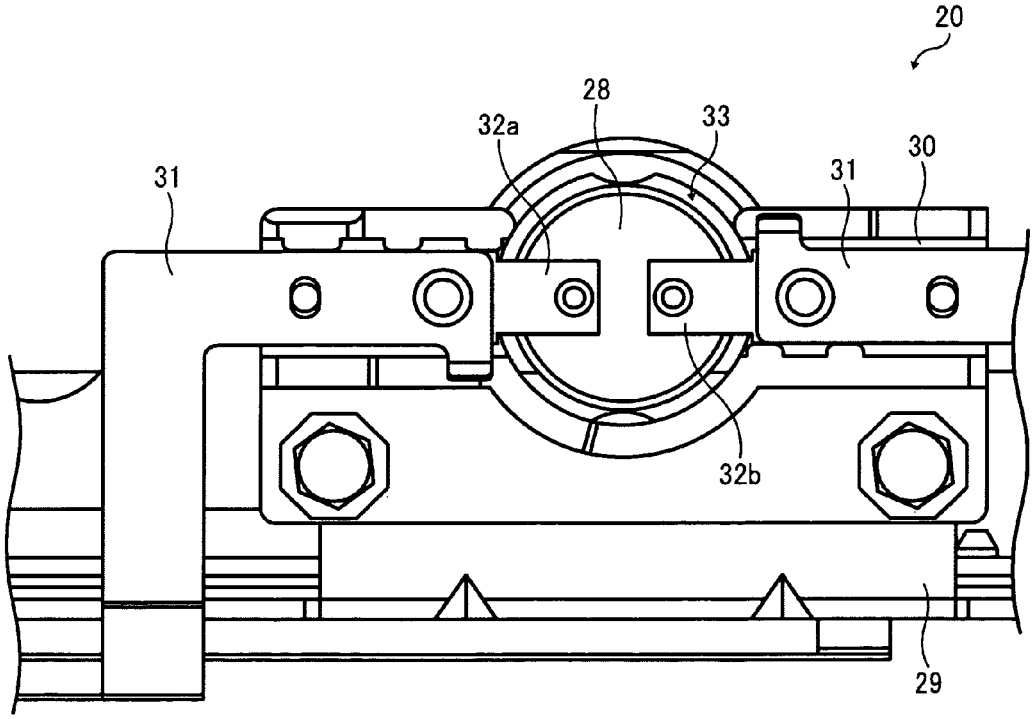
FIG. 4 is a schematic view illustrating the thermostat accommodated within a housing included in the fixing device illustrated in FIG. 2.

FIG. 4 is a schematic view illustrating the thermostat 28 accommodated within the housing 30 included in the fixing device 20 according to the first illustrative embodiment. As illustrated in FIG. 4, the thermostat 28 must be installed in such a way as to be accommodated within the housing 30 mounted to the frame 29. A portion of the housing 30 that accommodates the thermostat 28 is hereinafter referred to as an accommodation part 33. Because the electrode plates 31 connected to the thermostat 28 from the exterior of the thermostat 28 pass below the frame 29, the electrode plates 31 must be installed before installation of the thermostat 28 in the fixing device 20.

Figure 5:
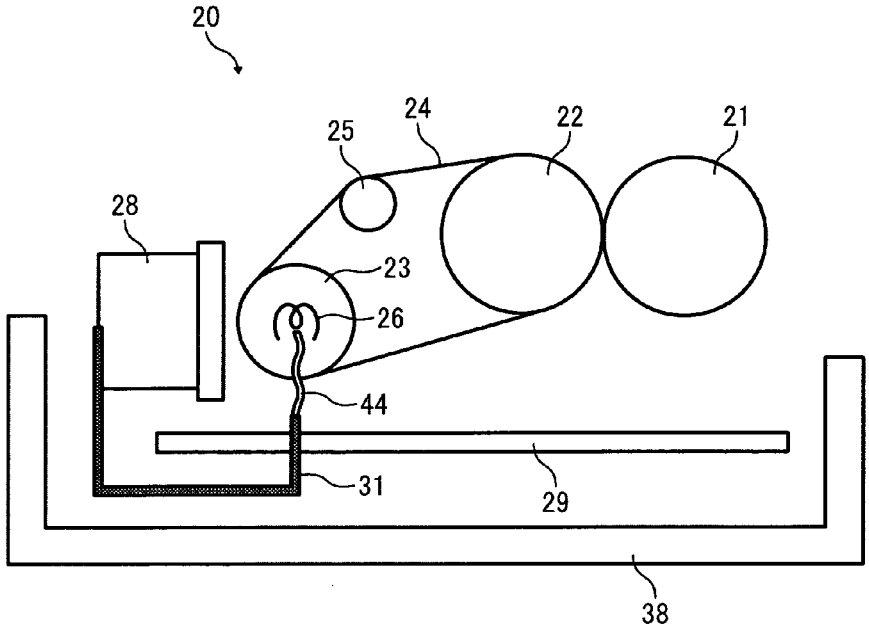
FIG. 5 is a vertical cross-sectional view illustrating another example of the configuration of the fixing device.

FIG. 5 is a vertical cross-sectional view illustrating another example of the configuration of the fixing device 20. Because it is uncoated and unprotected as described above, the electrode plates 31 must be spaced a certain distance apart from other metal sheet components such as the frame 29 to comply with safety standards. Further, the electrode plates 31 must be initially installed inside external members of the fixing device 20 such as a lower cover 38 in order to prevent electrical shock during installation. Therefore, as described above, the electrode plates 31 must be installed before installation of the thermostat 28 in the fixing device 20. In the example illustrated in FIG. 5, a portion of the conductive line from the heat source 26 to the thermostat 28 is formed of a harness 44, and the harness 44 is bonded to the electrode plate 31 connected to a terminal of the thermostat 28 (not shown in FIG. 5) at a predetermined position.

Figure 6:
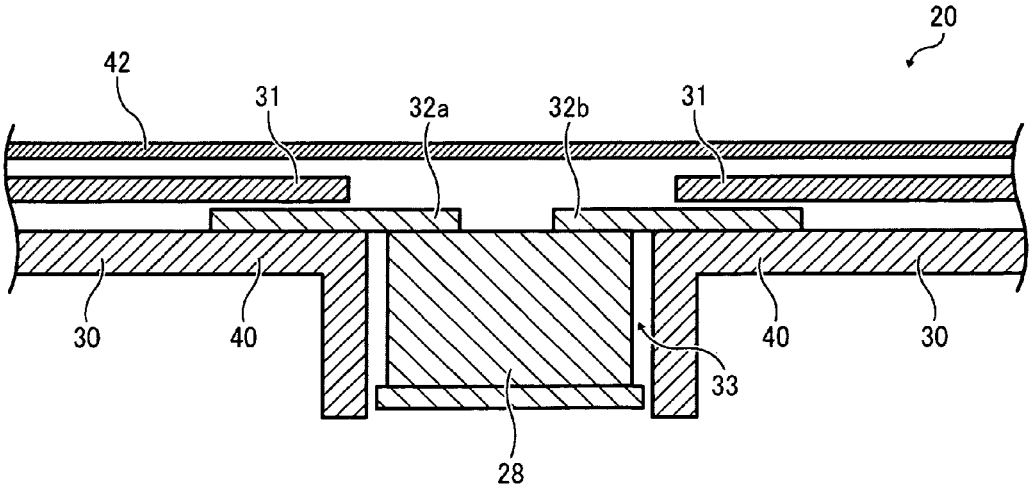
FIG. 6 is a schematic view illustrating the configuration of the fixing device according to the first illustrative embodiment in which the thermostat is accommodated within the housing.

FIG. 6 is a schematic view illustrating the configuration of the fixing device 20 according to the first illustrative embodiment in which the thermostat 28 is accommodated within the housing 30. Terminals 32*a* and 32*b* (hereinafter also collectively referred to as terminals 32) each formed of a metal material such as cold rolled steel plate (SPCC) coated with nickel are fixed to the thermostat 28. The terminals 32 contact an edge 40 of the housing 30 around the accommodation part 33 while the accommodation part 33 provided through the housing 30 accommodates the thermostat 28 therewithin to set a gap between the thermostat 28 and the fixing belt 24. As illustrated in FIG. 6, an external member 42 of the fixing device 20 is provided opposite the housing 30 with the electrode plates 31 interposed therebetween. It is to be noted that, for ease of illustration, the external member 42 is not shown in drawings other than FIG. 6.

Although one possible idea is installing the thermostat 28 outside the electrode plates 31, an accuracy in the installation position of the thermostat 28 may be decreased (or a tolerance accumulation may be increased) as a consequence due to thickness tolerance of the electrode plates 31. Therefore, it is preferable that the thermostat 28 be installed between the housing 30 and the electrode plates 31, both of which are installed before installation of the thermostat 28 in the fixing device 20.

Figure 7:
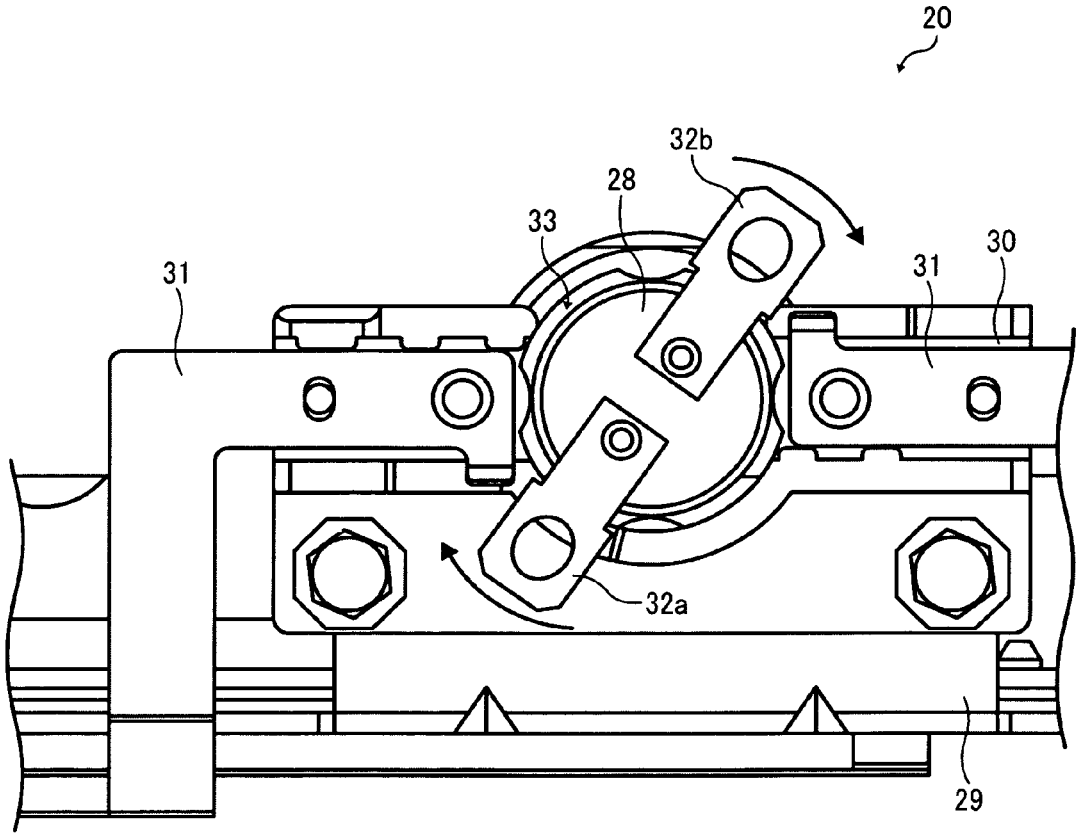
FIG. 7 is a schematic view illustrating the thermostat being rotated to insert terminals thereof into a gap formed between the electrode plates and the housing.

The thermostat 28 is rotated to be installed between the electrode plates 31 and the housing 30, both of which are installed in advance as described above. For example, after installation of the electrode plates 31 and the housing 30 in the fixing device 20, the thermostat 28 is placed at an angle and is rotated in a clockwise direction as illustrated in FIG. 7 so that the terminals 32 provided at both ends of the thermostat 28 are inserted between the electrode plates 31 and the housing 30, respectively. After the thermostat 28 is rotated and properly installed, the position of the thermostat 28 is as shown in FIG. 4.

As illustrated in FIG. 7, the fixing device 20 includes the housing 30 that contacts the terminals 32*a* and 32*b* fixed to the thermostat 28 to support the thermostat 28, and the electrode plates 31 provided opposite the housing 30 with a certain gap therebetween. The electrode plates 31 contact surfaces opposite to surfaces of the terminals 32 of the thermostat 28 contacting the housing 30 while the terminals 32 are positioned within the gap to form a part of the circuit. The electrode plates 31 include first guide parts 34, described in detail later, which guide the terminals 32 to be inserted into the gap formed between the electrode plates 31 and the housing 30.

Figure 8:
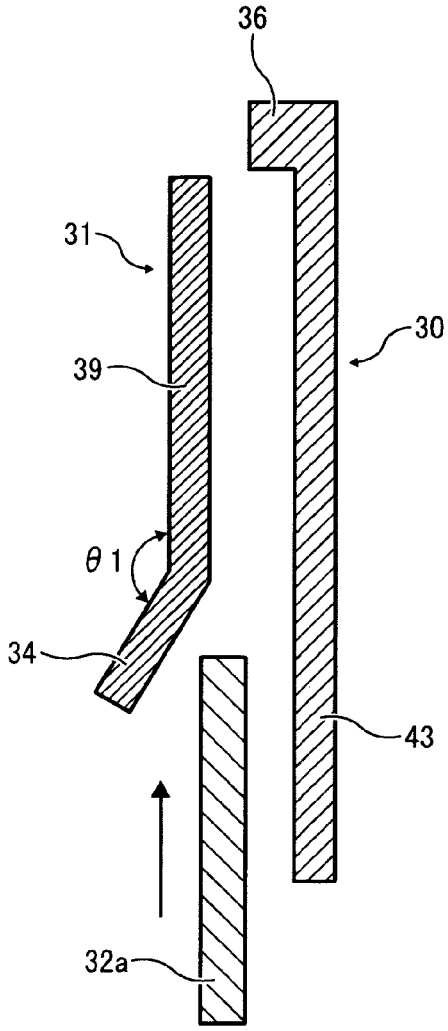
FIG. 8 is a vertical cross-sectional view illustrating the terminal to be inserted into the gap formed between the electrode plate and the housing in the fixing device according to the first illustrative embodiment.

FIG. 8 is a vertical cross-sectional view illustrating the terminal 32*a* of the thermostat 28 to be inserted into the gap formed between the electrode plate 31 and the housing 30 included in the fixing device 20 according to the first illustrative embodiment. It is to be noted that a configuration of the terminal 32*b* of the thermostat 28 is the same as that of the terminal 32*a* of the thermostat 28 to be described in detail below with reference to FIG. 8.

As illustrated in FIG. 8, the first guide part 34 is provided at a portion of the electrode plate 31 (hereinafter referred to as a connection part 39) where an insertion hole, not shown, for connection to the terminal 32*a* is provided, and is bent away from the housing 30. An angle θ1 formed between the first guide part 34 and the connection part 39 is obtuse. A portion of the housing 30 that does not face the electrode plate 31, that is, a portion of the housing 30 that does not face the electrode plate 31 and the terminal 32*a* when the terminal 32*a* of the thermostat 28 is connected to the electrode plate 31, is hereinafter referred to as a non-facing part 43.

Figure 9:
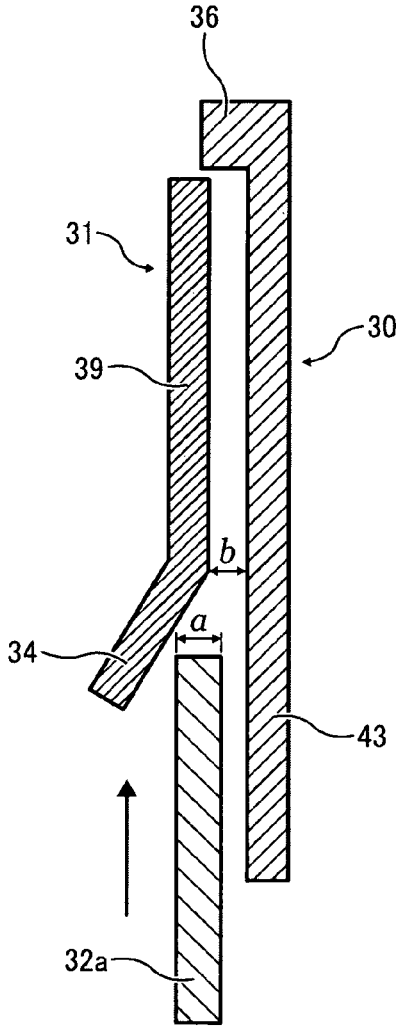
FIG. 9 is a vertical cross-sectional view illustrating relative positions of the terminal and the gap formed between the electrode plate and the housing respectively illustrated in FIG. 8.

FIG. 9 is a vertical cross-sectional view illustrating relative positions of the terminal 32*a* and the gap formed between the housing 30 and the electrode plate 31 respectively illustrated in FIG. 8. It is preferable that the electrode plates 31 be formed of an elastically deformable metal material, and a thickness a of the terminal 32*a* be larger than a gap b formed between the electrode plate 31 and the housing 30 into which the terminal 32*a* is inserted.

The terminal 32*a* is pressed against the first guide part 34 to bend the electrode plate 31 so that the terminal 32*a* is inserted into the gap formed between the electrode plate 31 and the housing 30 while the gap is widened. As a result, undesired rotation and slippage of the thermostat 28 can be prevented by an elastic force of the electrode plates 31.

As described above, provision of the first guide part 34 smoothly sets the terminals 32 of the thermostat 28 at the certain position to connect the thermostat 28 to the electrode plates 31 by the certain connection members when the thermostat 28 is rotated to be set at the certain position, thereby facilitating installation of the thermostat 28 in the fixing device 20.

In a case of detachment of the thermostat 28 from the fixing device 20, such as replacement of the thermostat 28 during maintenance, the electrode plates 31 are required to be floated temporarily so that the thermostat 28 is rotated in a direction opposite the direction of attachment of the thermostat 28 to the fixing device 20 to remove the thermostat 28 from the fixing device 20. Because the first guide part 34 is provided to the electrode plate 31 as described above, a user can hold the first guide part 34 to float the electrode plate 31, thereby facilitating replacement of the thermostat 28.

A description is now given of a second illustrative embodiment of the present invention.

Figure 10:
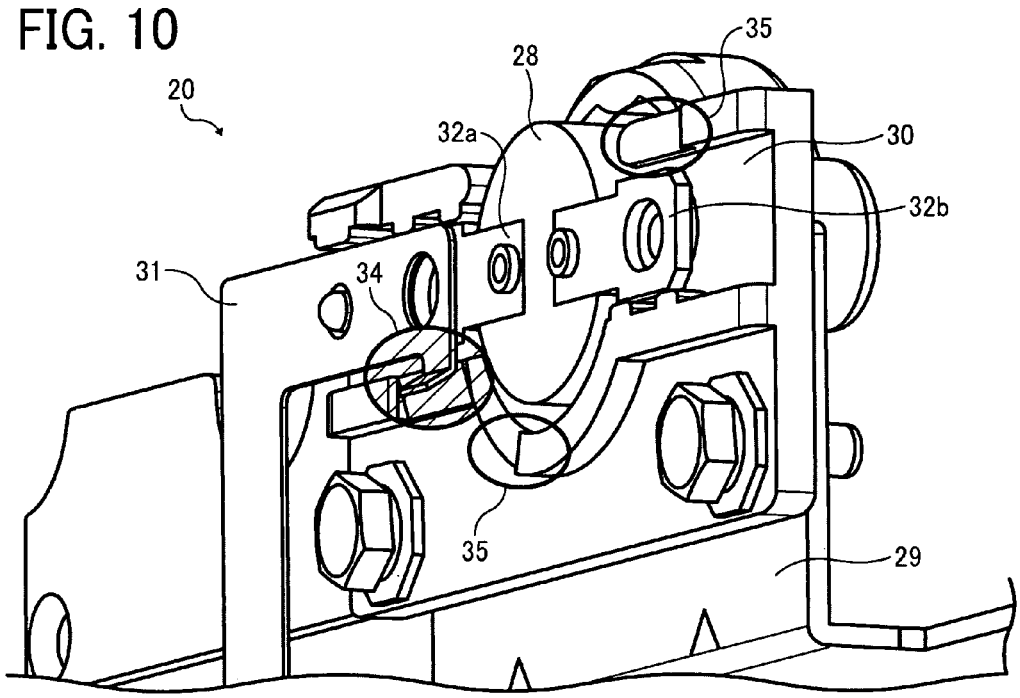
FIG. 10 is a perspective view illustrating the thermostat accommodated within the housing included in the fixing device according to a second illustrative embodiment.
Figure 11:
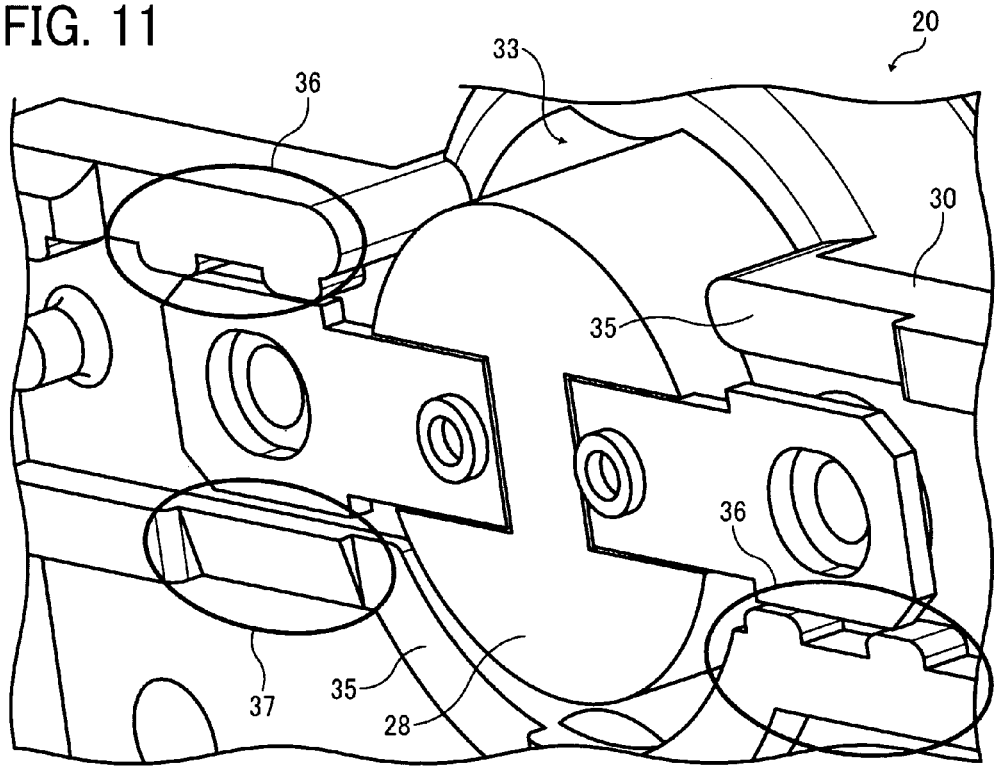
FIG. 11 is an enlarged perspective view illustrating the thermostat accommodated within the housing included in the fixing device according to the second illustrative embodiment.

FIGS. 10 and 11 are perspective views respectively illustrating the thermostat 28 accommodated within the housing 30 included in the fixing device 20 according to the second illustrative embodiment. Specifically, in the second illustrative embodiment, the first guide part 34 is provided to the electrode plate 31, and rotation guide parts 35 are provided to the housing 30. Further, engaging parts 36 and a support member guide part 37 are respectively provided to the housing 30. It is preferable that, as illustrated in FIGS. 10 and 11, the rotation guide parts 35 that guide rotation of the terminals 32 when the thermostat 28 is rotated, and/or the engaging parts 36 engaged with the terminals 32 at certain positions, that is, at connection positions, be provided to the housing 30, respectively. It is to be noted that the electrode plate 31 connected to the terminal 32*b* is not shown in FIG. 10, and the electrode plates 31 are not shown in FIG. 11, respectively, solely in order to more clearly illustrate the rotation guide parts 35 and the engaging parts 36.

Specifically, parts of an external rib of the housing 30 through which the terminals 32 pass while the thermostat 28 is rotated are cut to reduce a height thereof to form the rotation guide parts 35. As a result, the thermostat 28 can be fixed to the housing 30 more smoothly by rotation. Further, the rest of the external rib of the housing 30 functions as the engaging parts 36 to prevent undesired rotation and slippage of the thermostat 28.

Figure 12:
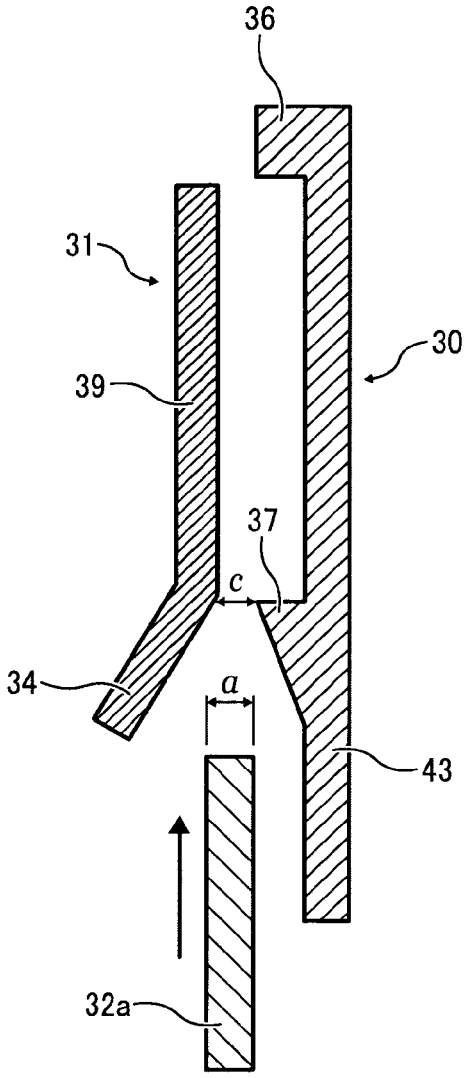
FIG. 12 is a vertical cross-sectional view illustrating the terminal to be inserted into the gap formed between the electrode plate and the housing in the fixing device according to the second illustrative embodiment.

It is preferable that the support member guide part 37 that guides insertion of the terminals 32 be provided at a position corresponding to the first guide part 34 on the surface of the housing 30. FIG. 12 is a vertical cross-sectional view illustrating the terminal 32*a* to be inserted into the gap formed between the electrode plate 31 and the housing 30 included in the fixing device 20 according to the second illustrative embodiment. As illustrated in FIG. 12, the support member guide part 37 has a sloped portion such that a gap c between the support member guide part 37 and the first guide part 34 is narrowed toward a direction of insertion of the terminal 32*a*. It is preferable that the thickness a of the terminal 32*a* be larger than the gap c between the first guide part 34 and the support member guide part 37 into which the terminal 32*a* is inserted.

Accordingly, provision of the support member guide part 37 to the housing 30 further facilitates attachment of the thermostat 28 to the fixing device 20, and prevents slippage of the thermostat 28. Specifically, because the thermostat 28 is vertically provided in the fixing device 20 according to illustrative embodiments, half of the thermostat 28 slips due to its own weight without a part to support the thermostat 28 even when the thermostat 28 is rotated as illustrated in FIG. 4 to be set to the fixing device 20. As a result, the thermostat 28 is returned to its original position. In other words, when installing the thermostat 28, the user is required to rotate the thermostat 28 and hold the thermostat 28 while fixing the thermostat 28 to the fixing device 20 with screws or the like. In the second illustrative embodiment, the support member guide part 37 that also functions as the part to hold the thermostat 28 after the thermostat 28 is rotated to be set to the fixing device 20 is provided to the housing 30 as described above, thereby preventing slippage of the thermostat 28 and facilitating installation of the thermostat 28 in the fixing device 20.

As described above, the first guide part 34 is provided to the electrode plate 31 so that the accommodation part 33 accommodates the thermostat 28 after the electrode plate 31 and the housing 30 are installed in the fixing device 20. The thermostat 28 is rotated while the terminals 32 contact or position closely to the non-facing part 43 so that the terminals 32 are guided by the first guide part 34, thereby easily setting the terminals 32 at the connection position. Further, the rotation guide parts 35, the engaging parts 36, and the support member guide part 37 are provided to the housing 30. Accordingly, the terminals 32 are rotated to the position connected to the electrode plates 31 while being guided by the rotation guide parts 35 and engage the engaging parts 36 and the support member guide part 37, thereby facilitating installation of the thermostat 28 in the fixing device 20.

Figure 13:
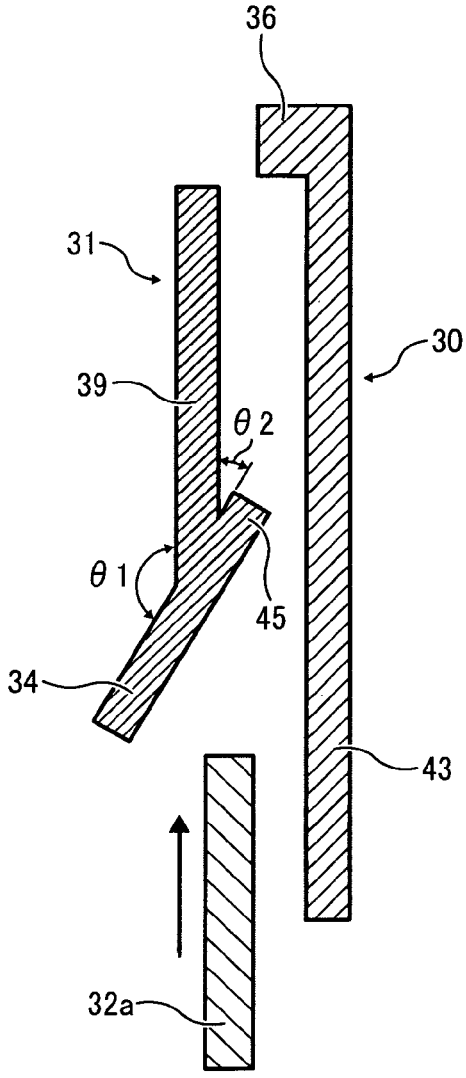
FIG. 13 is a vertical cross-sectional view illustrating the terminal to be inserted into the gap formed between the electrode plate and the housing in the fixing device according to a third illustrative embodiment.

Alternatively, in place of the support member guide part 37, a second guide part 45 that guides insertion of the terminals 32 together with the first guide part 34 may be provided to the electrode plate 31 as illustrated in FIG. 13. FIG. 13 is a vertical cross-sectional view illustrating the terminal 32*a* to be inserted into the gap formed between the electrode plate 31 and the housing 30 included in the fixing device 20 according to a third illustrative embodiment. The second guide part 45 is provided at the connection part 39 of the electrode plate 31 to be connected to the terminals 32 and is bent toward the housing 30. An angle θ2 formed between the second guide part 45 and the connection part 39 is acute.

The second guide part 45 provided to the electrode plate 31 can also hold the thermostat 28 set in the fixing device 20 in the manner similar to the support member guide part 37 provided to the housing 30 according to the second illustrative embodiment, thereby facilitating installation of the thermostat 28.

Thus, the thermostat 28 can be easily installed to the image forming apparatus 1 including the fixing device 20 described above.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

What is claimed is:

1. A fixing device comprising:

a fixing member;

a heat source to heat the fixing member;

a power supply to supply power to the heat source;

a thermostat provided in the middle of a circuit connecting the heat source and the power supply to block power supply from the power supply to the heat source upon detection of a temperature of the fixing member equal to or greater than a predetermined temperature;

a support member to contact terminals fixed to the thermostat to support the thermostat; and electrode plates provided opposite the support member with a gap therebetween to form a part of the circuit by connecting to surfaces of the terminals of the thermostat opposite surfaces thereof contacting the support member while the terminals are positioned within the gap, the electrode plates comprising a first guide part to guide the terminals into the gap.

2. The fixing device according to claim 1, wherein the first guide part is provided at a connection part of each of the electrode plates which is connected to the terminals, and is bent at an angle to the support member.

3. The fixing device according to claim 2, wherein the angle formed between the first guide part and the connection part is obtuse.

4. The fixing device according to claim 1, wherein the electrode plates are formed of an elastically deformable metal material.

5. The fixing device according to claim 1, wherein a thickness of each of the terminals is larger than a width of the gap formed between the electrode plates and the support member into which the terminals are inserted.

6. The fixing device according to claim 1, wherein the support member comprises a support member guide part that guides insertion of the terminals together with the first guide part, provided on a surface of the support member at a position corresponding to the first guide part.

7. The fixing device according to claim 6, wherein the support member guide part has a sloped portion that narrows a gap formed between the support member guide part and the first guide part toward a direction of insertion of the terminals.

8. The fixing device according to claim 1, wherein the electrode plates further comprise a second guide part provided at a connection part of each of the electrode plates which is connected to the terminals, the second guide part is bent at an angle to the connection part of the electrode plates toward the support member to guide insertion of the terminals together with the first guide part.

9. The fixing device according to claim 8, wherein the angle formed between the second guide part and the connection part is acute.

10. The fixing device according to claim 1, wherein:

the support member comprises:

an accommodation part passing through the support member to accommodate the thermostat; and a non-facing part provided at an edge of the accommodation part, the non-facing part facing away from the electrode plate; and the thermostat accommodated within the accommodation part is rotated while the terminals contact or position closely to the non-facing part to insert the terminals into the gap formed between the electrode plates and the support member.

11. The fixing device according to claim 10, wherein the support member further comprises engaging parts to engage with the terminals at predetermined positions upon rotation of the thermostat.

12. The fixing device according to claim 1, wherein the terminals are flat.

13. The fixing device according to claim 1, wherein the electrode plates form a part of the circuit connecting the thermostat and the heat source.

14. The fixing device according to claim 1, wherein the support member is made of resin.

15. An image forming apparatus comprising a fixing device, the fixing device comprising:

a fixing member;

a heat source to heat the fixing member;

a power supply to supply power to the heat source;

a thermostat provided in the middle of a circuit connecting the heat source and the power supply to block power supply from the power supply to the heat source upon detection of a temperature of the fixing member equal to or greater than a predetermined temperature;

a support member to contact terminals fixed to the thermostat to support the thermostat; and electrode plates provided opposite the support member with a gap therebetween to form a part of the circuit by connecting to surfaces of the terminals of the thermostat opposite surfaces thereof contacting the support member while the terminals are positioned within the gap, the electrode plates comprising a first guide part to guide the terminals into the gap.

* * * * *